United States Patent [19]

Sano

[11] Patent Number: 4,463,694

[45] Date of Patent: Aug. 7, 1984

[54] FABRIC FEED AMOUNT ADJUSTING DEVICE OF SEWING MACHINE

[75] Inventor: Yasuro Sano, Tokyo, Japan

[73] Assignee: Janome Sewing Machine Co., Ltd., Tokyo, Japan

[21] Appl. No.: 328,099

[22] Filed: Dec. 7, 1981

[30] Foreign Application Priority Data

Dec. 11, 1980 [JP] Japan ..... 55/17672[U]

[51] Int. Cl.[3] ..... D05B 3/02

[52] U.S. Cl. ..... 112/158 A

[58] Field of Search ..... 112/158 A, 158 D, 158 R, 112/314, 315, 316, 317

[56] References Cited

U.S. PATENT DOCUMENTS 4,196,682 4/1980 Hanyu et al. ..... 112/158 A 4,368,681 1/1983 Hanyu et al. ..... 112/158 A

*Primary Examiner*—Peter Nerbun

*Attorney, Agent, or Firm*—Michael J. Striker

[57] ABSTRACT

In a sewing machine which has both functions, such as ordinary pattern stitching, such as zigzag stitching, and a super pattern stitching to which forward and backward feeds are automatically given, an arrangement is provided which adjusts by a single member the amount of feed at selecting an ordinary pattern stitching and a super pattern stitching. The arrangement provides that the feed amount specified to a pattern, which is given from a feed cam fixed on an operating shaft of a pattern selecting dial, is increased or decreased within a determined range by operating a feed adjusting knob outside of a machine frame. For selecting the super pattern, the amount of the forward and backward feed given by an automatic feed cam is enlarged or reduced back or forth the stitching within a determined range by operating the same feed adjusting knob.

4 Claims, 12 Drawing Figures

FABRIC FEED AMOUNT ADJUSTING DEVICE OF SEWING MACHINE

BACKGROUND OF THE INVENTION

The invention relates to a device for adjusting the feed amount of a fabric being sewn, and more particularly to such a device that in the case of selecting an ordinary pattern stitch by fixedly setting the fabric feed amount, such as the zigzag stitching, the feed amount is increased or decreased with respect to a reference value thereof within a determined range by rotating a feed adjusting knob outside of the machine frame. Also, and in the case of selecting a super pattern stitch, the amount of forward or backward feed is enlarged or reduced within a determined range by rotating the knob.

In conventional sewing machines having both functions, the ordinary stitching and the super stitching are both independent in adjustment of the feeding mechanism. Therefore, it is difficult to provide these two adjustments via a single member. The fabric feed amount is in general is subject to the ordinary pattern stitching only. For forming the super pattern stitching, for example, stretch stitching or honey stitching, and if the fabric has high elasticity or large thickness, the fabric feed could not be fully obtained and would result in problems in the final product.

SUMMARY OF THE INVENTION

An object of the present invention is to provide a sewing machine which has both functions of the ordinary pattern stitching such as zigzag stitching, and the super pattern stitching to which the forward and backward feeds are automatically given. The feed amount specified to a pattern, which is given from a feed cam fixed on an operating shaft of a pattern selecting dial, is increased or decreased within a determined range by operating a feed adjusting knob outside of the machine frame, and for selecting the super pattern, the amount of the forward and backward feed given by the automatic feed cam is enlarged or reduced within the determined range by operating the feed adjusting knob. Furthermore, the ordinary and the super stitchings may be performed by adjusting the feed amount in response to conditions of the fabric to be sewn.

BRIEF DESCRIPTION OF THE DRAWINGS

FIGS. 6 to 8 show each adjusting condition of selecting ordinary pattern stitching, wherein FIG. 6 shows setting a dial at center of adjusting range thereof, FIG. 7 shows rotation of the dial in a plus (+) direction until the maximum position of the adjusting range, and FIG. 8 shows rotation of the dial in a minus (−) direction until the maximum position of the adjusting range, FIGS. 9 to 12 show each adjusting condition of selecting the super pattern stitching, wherein FIGS. 9 and 10 are shown settings of the dial at center of the adjusting range, each showing forward feed and backward feed by means of an automatic feed cam, and FIGS. 11 and 12 are rotation of the dial to the plus (+) direction from the conditions in FIGS. 9 and 10, each showing the forward feed and the backward feed by means of the cam.

DETAILED DESCRIPTION OF THE PREFERRED EMBODIMENTS

Figure 1:
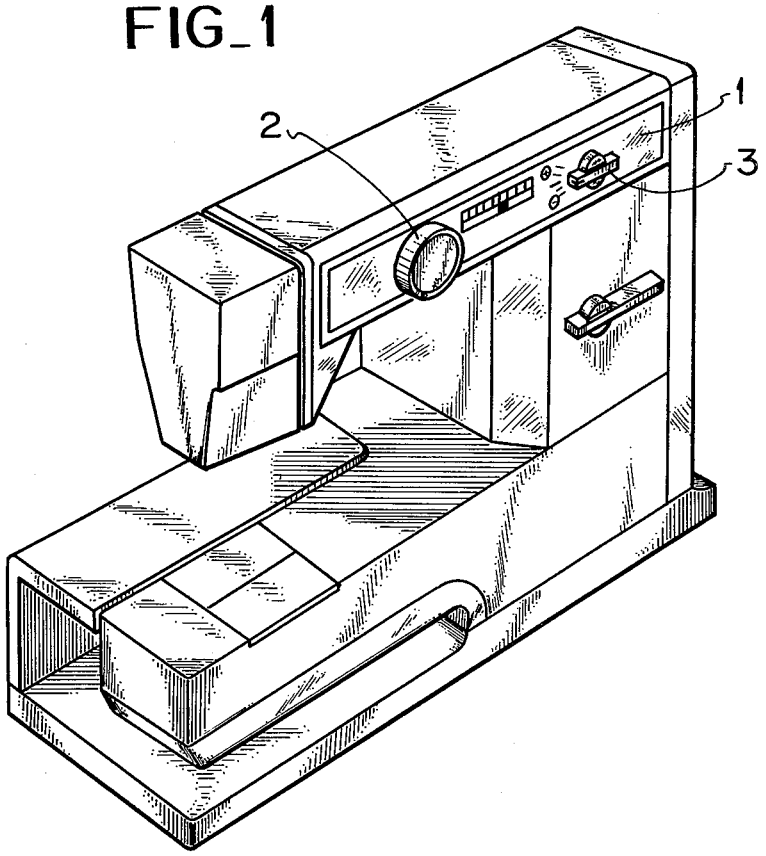
FIG. 1 is a perspective view of a sewing machine where a feed adjusting device according to the present invention is installed.

The present invention will be explained with reference to the attached drawings. In FIG. 1, a front panel 1 of a sewing machine is disposed with a pattern selecting dial 2 and a feed control knob 3. When the ordinary pattern stitching, such as zigzag stitching, is selected by the dial 2, the fabric feed amount is continuously changed by rotating the knob 3 within a range of, e.g., ±50% under a condition that the fabric feed amount specified to each of the stitching patterns is at the reference value as will be later mentioned. When the super pattern stitching is selected, the pitch of the forward or backward feed is enlarged or reduced by the knob 3 in the forward or backward direction.

Figure 2:
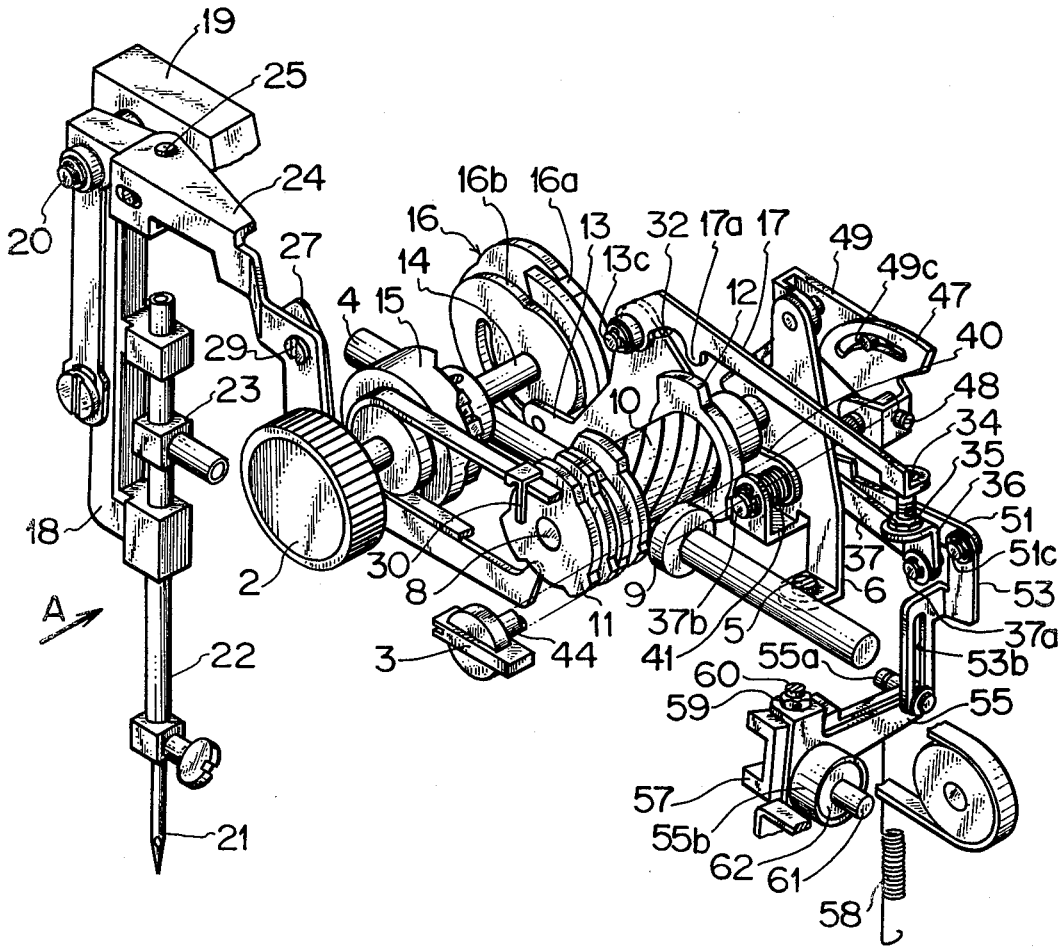
FIG. 2 is a perspective view showing an element mechanism of the sewing machine.

In FIG. 2, a main shaft 4 is rotatably mounted to an arm shaft of the sewing machine, and is rotated by a driving source (not shown).

Figure 3:
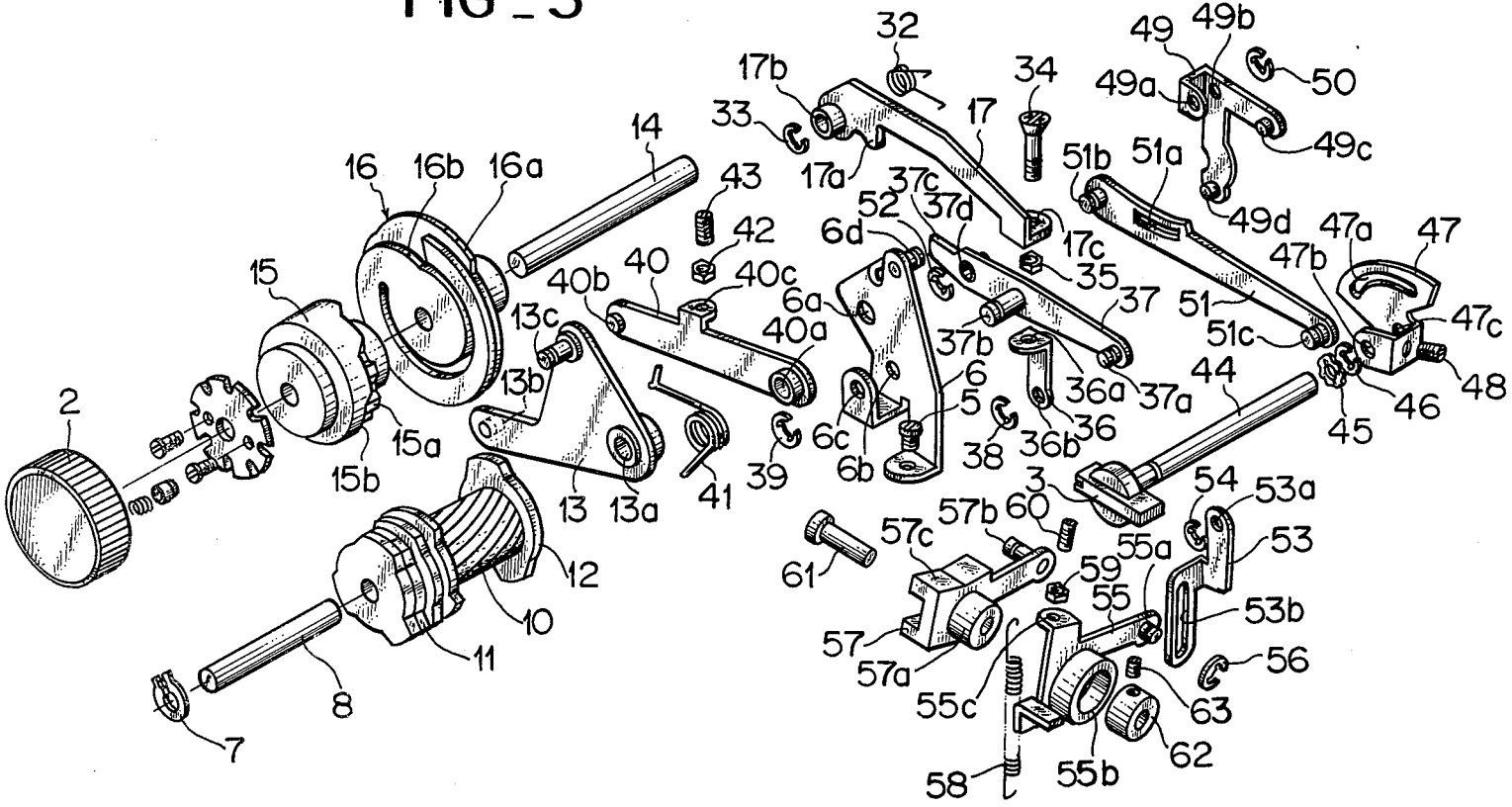
FIG. 3 is a partial exploded view showing the element mechanism of FIG. 2.

Also referring to FIG. 3, a cam shaft 8 is held on an arm frame by a hole 6*a* defined in a support plate 6 secured to the arm frame by a screw 5. Cam shaft 8 is effected with a thrust stop by means of a grip ring 7. The cam shaft 8 is mounted with a worm wheel 10 gearing a worm 9 fixed on the main shaft 4, a cam group 11 for needle swinging amplitude which is rotated together with the worm wheel 10, and a cam 12 for automatic feed. The cam shaft 8 is rotatably mounted with a selecting plate 13 through a hole 13*a* defined therein which is biased by a spring (not shown) to the clockwise direction around the cam shaft 8. An operating shaft 14 is supported on the arm frame parallel to the cam shaft 8. This shaft 14 is secured with a selecting cam body 15 and a cam body 16. The selecting cam body 15 has an outer cam 15*a* (seen in FIG. 3) for selecting the cam group 11 and an axial cam 15*b*. The cam body 16 has a feed cam 16*a* which generates a constant feed particular to each of the stitching patterns for the zigzag stitching, and a super stitch selecting cam 16*b* which contacts, as later will be mentioned, a follower 17*a* of a feed arm 17 to a cam 12. The operating shaft 14 is operated by the pattern selecting dial 2 outside of the machine frame. The selecting cam 16*b* follows a pin 13*b* of a selecting plate 13.

A needle supporter 18 is pivoted at its upper portion on a pin 20 secured to the arm frame 19 and biased by a spring (not shown) to the counterclockwise direction in FIG. 2. It supports at its lower portion a needle bar 22 which holds a needle 21. The needle bar 22 is vertically moved in association with rotation of the main shaft 4 by means of a needle bar holder 23 fixed to the needle bar and crank mechanisms.

Figure 4:
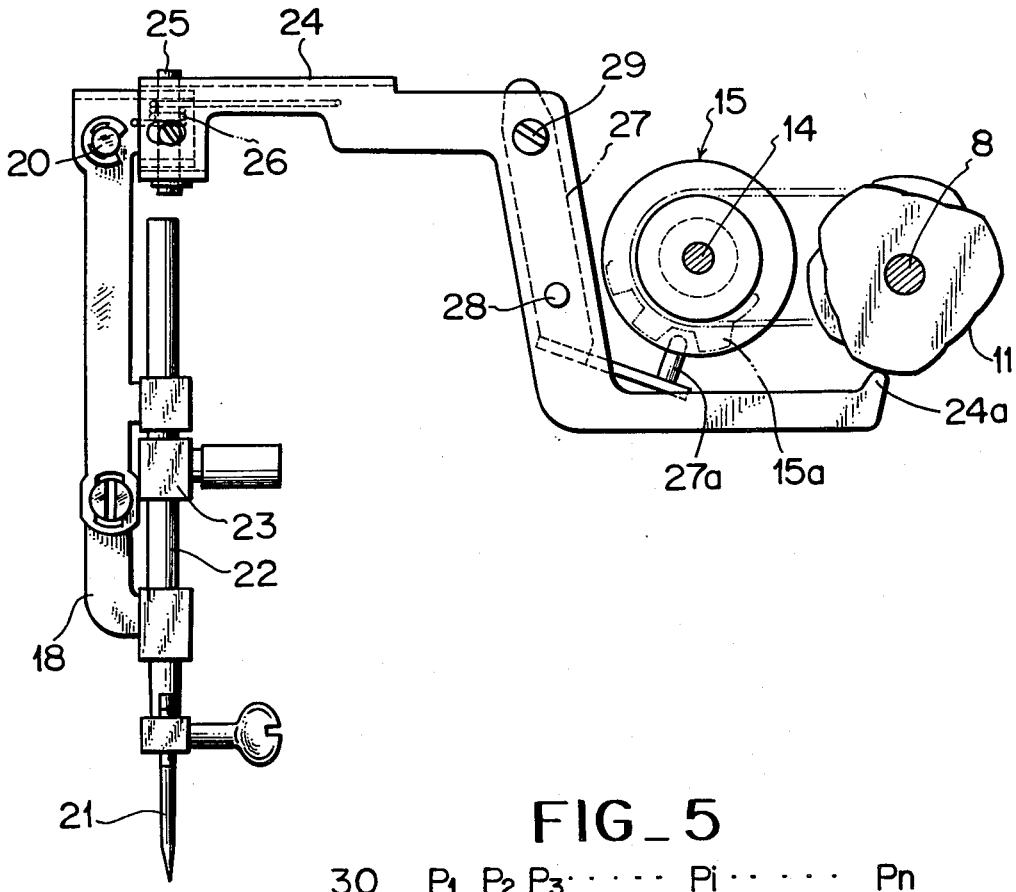
FIGS. 4 and 5 show views seen from arrow A in FIG. 2.
Figure 5:
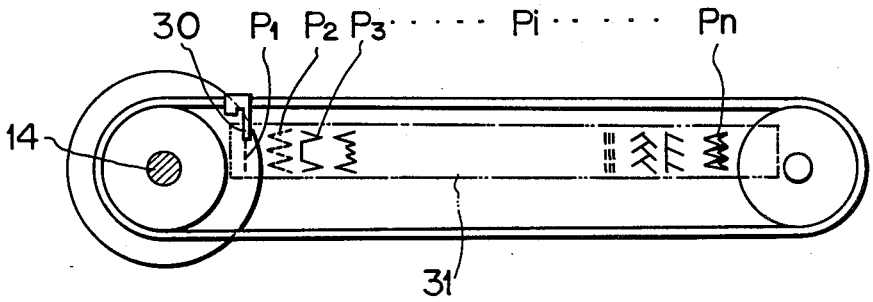

A swinging amplitude transmission lever 24 is rotatably pivoted in the lateral direction at its base on an upper portion of the needle bar supporter 18, and is biased by a spring 26 (FIG. 4) around the pin 25 in the clockwise direction (seen from the upper part in FIG. 2). The transmission lever 24 is formed at its end with a first amplitude follower 24*a* which is contacted to the cam group 11 by biasing force of a spring (not shown), and is provided at its center with a member 27 by a pin 28 and a screw 29, the member 27 being provided with a follower 27*a* which is integrally formed with a point contacting portion to an outer cam 15*a* of the selecting cam body 15 and a side contacting portion to the axial cam 15*b*. With reference to FIG. 5, pattern selection is carried out by meeting an indicator 30 to one of the stitching pattern indications (Pi) appearing on the pattern indicating panel 31 through rotation of the dial 2. In the course of pattern selection by rotation of the dial 2, the first follower 24*a* is released from the cam group 11 by the outer cam 15*a*, and the swinging amplitude transmission lever 24 is rotated by the axial cam 15*b* around the pin 25 via the follower 27*a*. As a result, the first follower 24*a* is moved toward the direction of the cam group 11, and is contacted by the axial cam 15*a* to one cam of the cam group 11.

Referring to FIG. 3, a feed arm 17 is mounted on a rod portion 13*c* of the selecting plate 13 via a boss 17*b* thereof and is biased by a spring 32 to the counterclockwise direction. The feed arm 17 is effected with the thrust stop by means of E-ring 33. Further the feed arm 17 is inserted with a screw 34 into a hole 17*c* at its end portion, the screw 34 being secured with a nut 35 and a rod 36 via screw portion 36*a*. The rod 36 is inserted with a pin 37*a* of the feed arm 37 into a hole 36*b* thereof and is effected with the thrust stop by means of E-ring 38. The feed arm 37 inserts at its rod portion 37*b* into a holes 6*b* and 6*c* of the plate 6, and the rod portion 37*b* is effected with the thrust stop by means of E-ring 39. Around these holes, the selecting arm 40 is mounted on the rod portion 37*b* via the boss 40*a*, and is biased by a spring 41 to the clockwise direction, so that its pin 40*b* follows the feed cam 16*b*. The selecting arm 40 is provided on its screw portion 40*c* with a nut 42 and a screw 43. When selecting the ordinary stitching, the screw 43 contacts at its lower part an upper face 37*c* of the feed arm 37, as mentioned infra, in order to restrain rotation of the feed arm 37 in the clockwise direction in FIG. 3. A shaft 44 securing the knob 3 is equipped with a wave shaped washer 45 and E-ring 46 for generating friction with respect to the arm frame when the shaft 44 is rotated. A feed control cam 47 formed with a groove cam portion 47*a* is secured by a screw 48 on the shaft 44 via holes 47*b* and 47*c*. A feed adjust arm 49 is formed with holes 49*a* and 49*b* into which a pin 6*d* of the plate 6 is inserted, and is effected with a thrust stop by means of E-ring 50. The pin 49*c* is engaged in a groove portion 47*a*, and when the knob 3 is rotated, the feed adjusting cam 47 is rotated and the feed adjusting arm 49 is turned.

The feed arm 37 is pivoted in its hole 37*d* with the feed arm 51 via its pin 51*b* on an end thereof, which is formed with an oblong groove 51*a* in the vicinity of its middle part, and is effected with a thrust stop by means of E-ring 52. The oblong groove 51*a* is inserted with a pin 49*d* of the feed adjusting arm 49, and a pin 51*c* on the other end is connected with a rod 53 via a hole 53*a*, and is effected with a thrust stop by means of E-ring 54. The rod 53 is inserted in its oblong groove 53*b* with a pin 55*a* of the feed adjusting plate 55, and is effected with a thrust stop by means of E-ring 56.

A feed adjustor 57 is mounted on its boss 57*a* with a boss 55*b* of a feed adjusting plate 55. The adjustor 57 is biased in the clockwise direction by means of a spring 58 whose one end is held on one end of a pin 57*b*. The adjustor 57 is contacted at its upper face 57*c* to a screw 60 on its lower face which is secured in the screw 55*c* of the feed adjusting plate 55 together with a nut 59 in order to limit rotation thereof. The adjustor 57 is pivoted on a shaft 61 which is attached to the arm frame by a bush 62 and a screw 63. As mentioned above, the feed adjustor 57 is biased by the spring 58 to the clockwise direction via the pin 57*b*, so that the feed adjusting plate 55 is biased in the same direction via the screw 60 contacting the feed adjustor 57 on its upper face 57*c*, and the feed arm 51 is biased in the same direction around the pin 49*d* of the feed adjusting arm 49 via the rod 53, and further the feed arm 37 is biased to the shaft 37*b* via the pin 51*b*.

Figure 6:
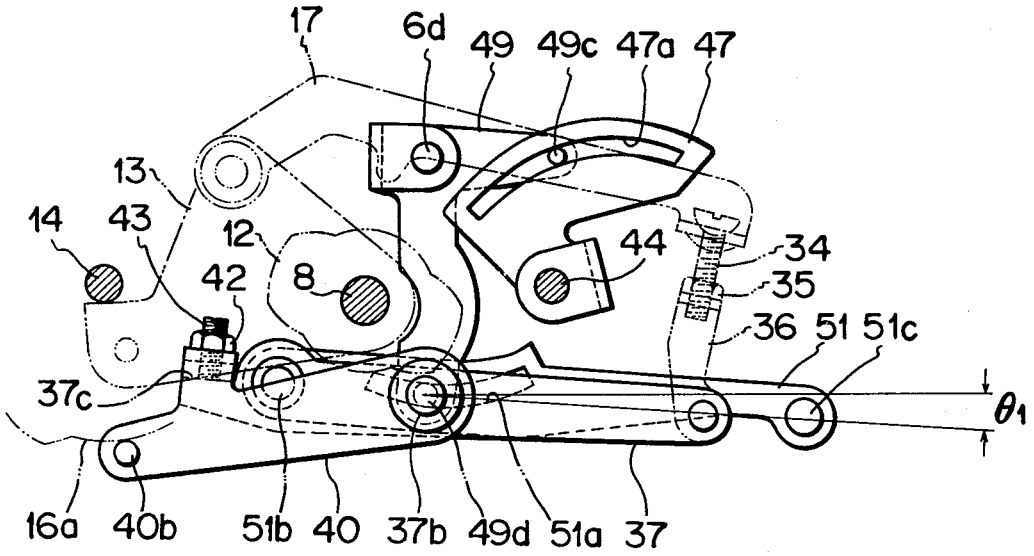

Reference is now made to the operation of the present device as described above. According to the feed adjusting device of the present invention when the ordinary pattern, such as the zigzag stitching, is selected by rotating the dial 2 the fabric feed amount can be continuously changed by rotating the knob 3 at the appropriate rate, for example, within a range of ±50%, under the condition that the fabric feed amount specific to each of the stitching patterns is a reference value. That is, when the ordinary stitch is selected by rotating the dial 2, the pin 40*b* of the selecting arm 40 follows the feed cam 16*a* which gives the fabric feed for the ordinary stitching. FIG. 6 shows that the knob 3 is set at the center of the adjusting range under this condition. The feed arm 51 which is indirectly biased by the spring 58 in the clockwise direction to the pin 49*d* of the feed adjusting arm 49 is positioned at the position where the feed arm 37 contacts the lower end of the screw 43 at its upper face 37*c*. Under this condition, the center of the rod portion 37*b* of the feed arm 37 meets the center of the pin 49*d* of the feed adjusting arm 49, and the feed arm 51 is made oblique by $\theta_1$ from the position where the pin 51*c* gives the feeding amount 0 to the feed adjustor 57 around the pin 49*d*, thereby obtaining a certain forward feeding amount of the fabric.

Figure 7:
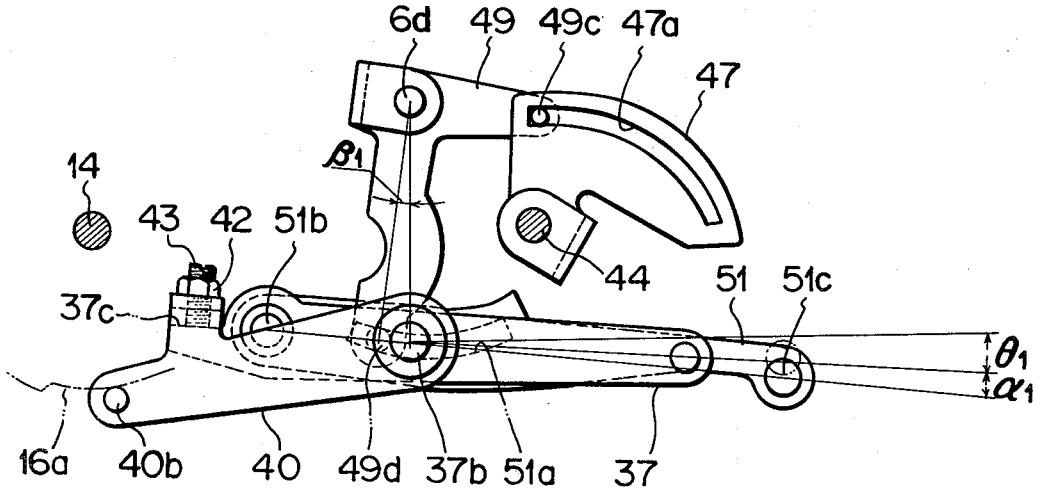

When the feed adjusting knob 3 is rotated to the maximum in the plus (+) direction as shown in FIG. 7 the feed adjusting cam 47 rotates and the feed adjusting arm 49 is rotated by $\beta_1$ as shown at the pin 6*d* so that the pin 49*d* is moved within the oblong groove 51*a*, whereby the pin 51*c* of the feed arm 51 is made further oblique by $\alpha_1$. Then the condition shown in FIG. 6 and the feeding amount is increased by a certain rate in the forward feeding side with respect to the condition shown in FIG. 6.

Figure 8:
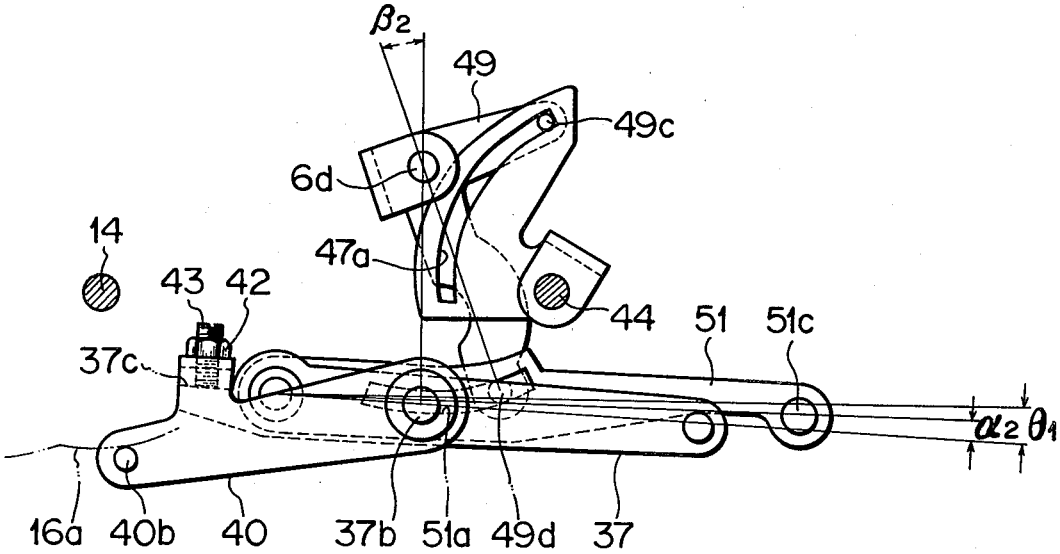

When the feed adjusting knob 3 is rotated to the maximum in the minus (−) direction as shown in FIG. 8, the feed control cam 47 rotates and the feed adjusting arm 49 is rotated by $\beta_2$ as shown at the pin 6*d* so that the pin 49*d* is moved within the oblong groove 51*a*, whereby the pin 51*c* of the feed arm 51 is decreased in the obliquity by $\alpha_2$. Then the condition shown in FIG. 6 and the feeding amount is decreased by a certain rate in the forward feeding amount with respect to the condition shown in FIG. 6.

Since the knob 3 can be continuously rotated, the feed arm 51 can be continuously adjusted accordingly, with regard to the oblique angle within the range of $\theta_1+\alpha_1$ and $\theta-\alpha_2$ in the above mentioned example, and the feeding amount can be set at the desired value.

According to the feed adjusting device of the present invention, in the selection of the super pattern the amount of the forward or backward feed may be enlarged or reduced at the certain rate. That is, when the dial 2 is rotated to select the super pattern, a corresponding cam is selected from the cam group 11 and the selecting plate 13 is rotated by the selecting cam 16*b* around the cam shaft 8 to the counterclockwise direction via the pin 13*b*, in FIG. 3, so that the feed arm 17 goes down to cause the follower 17*a* to contact the cam 12. Furthermore the selecting arm 40 is rotated by the selecting cam 16*a* around the boss 40*a* in the clockwise direction via the pin 40*b*. The arm 37, which is connected to the feed arm 17 via the screw 34 and the rod 36, is turned by the cam 12 under the condition that the upper face 37*c* of the feed arm 37 does not contact the lower end of the screw 43 fixed to the selecting arm 40. The feed arm 51 is turned by the feed arm 37 around the pin 49*d* of the feed adjusting arm 49 via the pin 51*b*. When the knob 3 is set at the center of the adjusting range under the above mentioned condition, the constant forward or backward feed is obtained.

Figure 9:
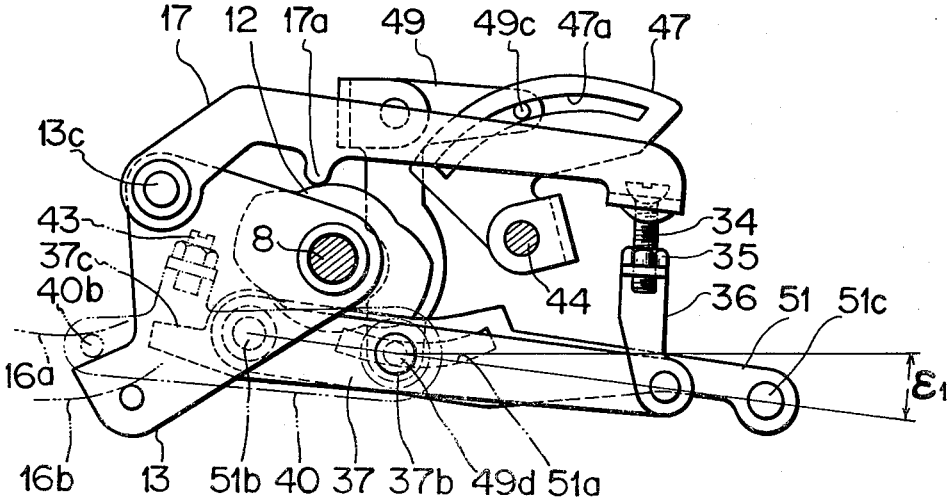
Figure 10:
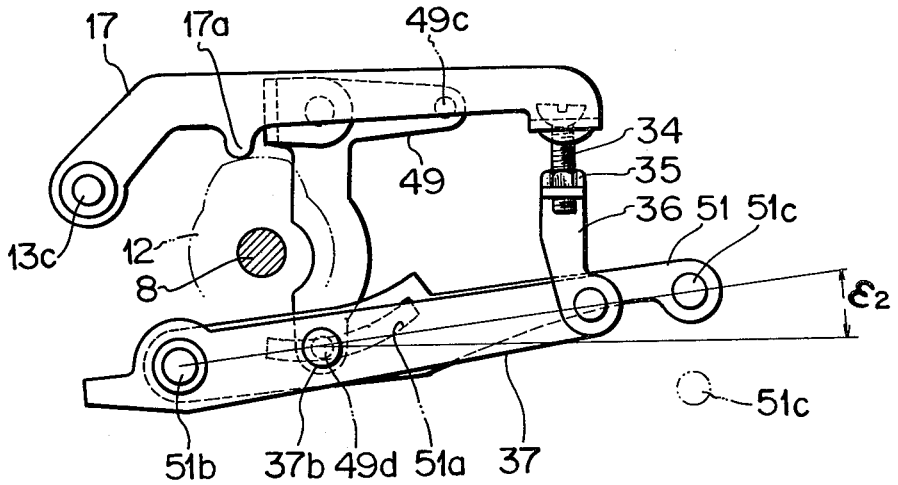

In FIGS. 9 and 10, the screw 43 of the selecting arm 40 is separated from the feed arm 37, and the selecting plate 13 is rotated by the selecting cam 16*b* in the counterclockwise direction so that the follower 17*a* of the feed arm 17 follows the cam 12 and the feed amount is given by the cam 12. When the knob 3 is set at the center of the adjusting range, the center of the rod portion 37*b* of the feed arm 37 meets the center of the pin 49*d* of the feed adjusting arm 49. In FIG. 9, the follower 17*a* follows the concave portion of the cam 12. The feed arm 51 is made oblique by $\epsilon_1$ in the clockwise direction around the pin 49*d* via the feed arm 17, the screw 34, the rod 36 and the feed arm 37, from the position where the pin 51*c* gives the feed amount 0 to the feed adjustor 57, and thus the required forward feed is obtained. In FIG. 10, the follower 17 the follows a convex portion of the cam 12. The feed arm 51 is made oblique by $\epsilon_2$ in the counterclockwise direction around the pin 49*d*, via the feed arm 17, the screw 34, the rod 36, and the feed arm 37, from the position where the pin 51*c* gives the feed amount 0 to the feed adjustor 57, and thus the required backward feed is obtained. The above mentioned $\epsilon_1$ and $\epsilon_2$ may be made equal on design, and therefore super stitching may be performed which is equal in the forward and the backward feed.

Figure 12:
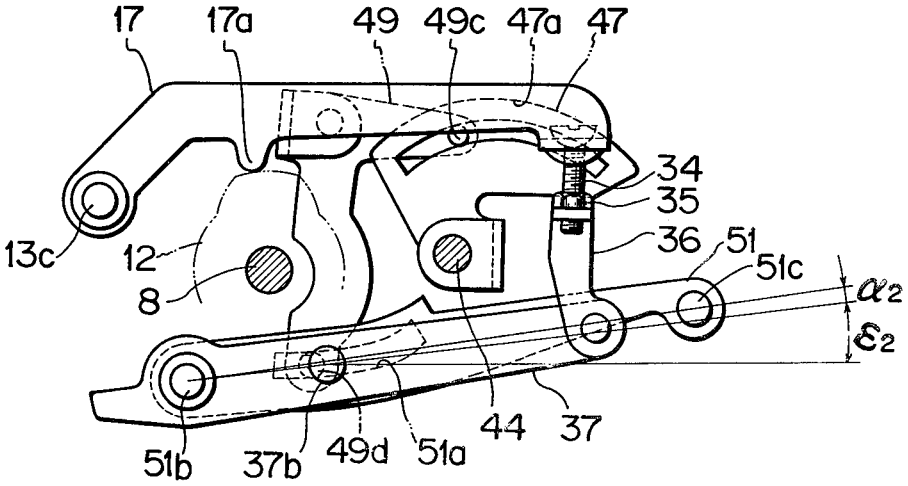
Figure 11:
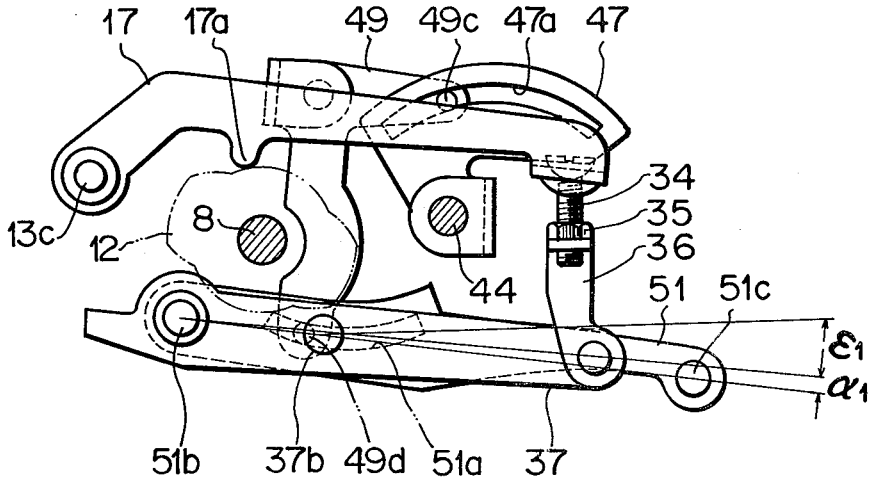

When the knob 3 is rotated from the condition in FIGS. 9 and 10 to the plus (+) direction, the feed control cam 47 is, as shown in FIG. 11, rotated in the clockwise direction via the shaft 44. Since the feed adjusting arm 49 is rotated around the pin 6*d* and the pin 49*d* moves within the oblong groove 51*a* of the feed arm 51, and if the follower 17*a* follows the concave portion of the cam 12 as seen in FIG. 11, the pin 51*c* is increased in the obliquity by $\alpha_1$ with respect to the condition in FIG. 9, and said forward feed is enlarged. When the follower 17*a* follows the convex portion of the cam 12, FIG. 12 the obliquity is increased by $\alpha_2$ and said backward feed is enlarged. The above mentioned $\alpha_1$ and $\alpha_2$ may be made equal on design, and therefore the feed amount of the forward and backward are equal.

For forming the stretch stitch on the honey pattern as an example of the super stitch, the invention can solve the conventional disadvantage that the forward and backward feed cannot be satisfactorily provided in case of the thick fabric. When the knob 3 is rotated to the minus (−) direction, the amounts of the forward and backward feeds may be equally reduced as mentioned above.

I claim:

1. A fabric feed amount adjusting device for a sewing machine adapted for ordinary pattern stitching and super stitching with automatically given forward and backward fabric feeds and having a front panel carrying a pattern selecting panel, a pattern selecting dial in connection with said pattern selecting panel and a feed adjusting knob, and a machine frame with a support plate secured thereto, the device comprising means for adjusting the fabric feed amount when an ordinary stitching pattern is selected and for adjusting the fabric feed amount when a super stitching pattern is selected, said means including an operating shaft of said pattern selecting dial and a feed cam fixed on the operating shaft, and operative in such a fashion that the feed amount specified to a pattern is increased or decreased within a predetermined range defined by operating of said feed adjusting knob when an ordinary stitching pattern is selected, and an automatic feed cam for providing the amount of the forward and backward feed, said means being further operative for enlarging or reducing the feed movement in the forward and backward directions within a predetermined range defined by operating said feed adjusting knob when a super stitch pattern is selected, said means further including a first feed arm having a center portion pivotally mounted in said support plate, a selecting arm operatively interconnected between said feed cam and said first feed arm, a second feed arm pivoted at its one end to said first feed arm, a feed adjusting arm pivotally mounted to said support plate and cooperating with a shaft of said feed adjusting knob and operatively connected to said second feed arm, said first feed arm being restrained in obliquity with respect to said second feed arm via said feed cam and selecting arm at selecting an ordinary stitch pattern.

2. The device of claim 1, wherein said means further include a third feed arm actuated by said automatic feed cam, said first arm being restrained in its obliquity by said third feed arm at selecting a super stitch pattern.

3. The device of claim 2, wherein said means further comprise a feed adjustor, and a feed control cam mounted on the shaft of said feed adjusting knob, said second feed arm including a pin operative for adjusting obliquity of said feed adjustor and being formed with an oblong groove receiving a first pin mounted on said feed adjusting arm.

4. The device of claim 3, wherein said feed adjusting arm includes a second pin, said feed control cam including a groove cam portion for receiving said second pin whereby said feed adjusting arm connects said feed control cam and thus feed adjusting knob to said second feed arm.

* * * * *